US008912987B2

(12) United States Patent
Ka

(10) Patent No.: US 8,912,987 B2
(45) Date of Patent: Dec. 16, 2014

(54) ORGANIC LIGHT EMITTING DISPLAY DEVICE AND DRIVING METHOD THEREOF

(75) Inventor: Ji-Hyun Ka, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 113 days.

(21) Appl. No.: 13/592,592

(22) Filed: Aug. 23, 2012

(65) Prior Publication Data

US 2013/0321479 A1 Dec. 5, 2013

(30) Foreign Application Priority Data

May 29, 2012 (KR) ..... 10-2012-0056804

(51) Int. Cl.
*G09G 3/30* (2006.01)
*G09G 5/00* (2006.01)

(52) U.S. Cl.
USPC ..... 345/76; 345/82; 345/211

(58) Field of Classification Search
CPC ..... G09G 3/3233–3/3258; G09G 2310/0251; G09G 2320/0233
USPC ..... 345/76, 77, 204, 205, 211–215, 690; 315/169.3
See application file for complete search history.

(56) References Cited

U.S. PATENT DOCUMENTS 5,223,927 A * 6/1993 Kageyama et al. ..... 348/180
7,742,066 B2 * 6/2010 Choi ..... 345/691
7,755,585 B2 * 7/2010 Kim ..... 345/92
8,237,634 B2 * 8/2012 Kwak ..... 345/76
8,242,984 B2 * 8/2012 Choi ..... 345/76
8,269,703 B2 * 9/2012 Park ..... 345/80
8,319,708 B2 * 11/2012 Yoo et al. ..... 345/76
8,325,118 B2 * 12/2012 Senda ..... 345/82
8,378,931 B2 * 2/2013 Kim et al. ..... 345/76
8,462,085 B2 * 6/2013 Inoue et al. ..... 345/77
8,471,790 B2 * 6/2013 Inoue et al. ..... 345/77
8,514,154 B2 * 8/2013 Inoue et al. ..... 345/77
2005/0285822 A1 * 12/2005 Reddy et al. ..... 345/76
2006/0007204 A1 * 1/2006 Reddy et al. ..... 345/204
2006/0007205 A1 * 1/2006 Reddy et al. ..... 345/204
2006/0007206 A1 * 1/2006 Reddy et al. ..... 345/204
2006/0007248 A1 * 1/2006 Reddy et al. ..... 345/690
2006/0007249 A1 * 1/2006 Reddy et al. ..... 345/690

(Continued)

FOREIGN PATENT DOCUMENTS

KR 10-0739318 7/2007
KR 10-0939849 1/2010

OTHER PUBLICATIONS

Korean Patent Abstract No. 10-2009-0048823 A, published May 15, 2009 for KR 10-0939849 listed above, 1 page.

(Continued)

*Primary Examiner* — Dmitriy Bolotin
(74) *Attorney, Agent, or Firm* — Christie, Parker & Hale, LLP

(57) ABSTRACT

An organic light emitting display device capable of stably compensating for a threshold voltage of a driving transistor is provided. The organic light emitting display device includes pixels each having a driving transistor and being configured to initialize a voltage of the driving transistor by an initialization power, a gray level determining unit for generating a gray level value using externally supplied data, and an initialization power generator for controlling a voltage level of the initialization power to correspond to the gray level value.

16 Claims, 2 Drawing Sheets

(56) References Cited

U.S. PATENT DOCUMENTS

| | | | | |
|---|---|---|---|---|
| 2006/0077138 | A1* | 4/2006 | Kim | 345/76 |
| 2007/0080905 | A1* | 4/2007 | Takahara | 345/76 |
| 2007/0080909 | A1* | 4/2007 | Jeon et al. | 345/77 |
| 2007/0103406 | A1* | 5/2007 | Kim | 345/76 |
| 2007/0229411 | A1* | 10/2007 | Choi | 345/76 |
| 2008/0018629 | A1* | 1/2008 | Uchino et al. | 345/205 |
| 2008/0024400 | A1* | 1/2008 | Uchino et al. | 345/77 |
| 2009/0251392 | A1* | 10/2009 | Kim et al. | 345/76 |
| 2009/0273547 | A1* | 11/2009 | Tanikame et al. | 345/76 |
| 2010/0013816 | A1* | 1/2010 | Kwak | 345/211 |
| 2010/0033409 | A1* | 2/2010 | Park | 345/76 |
| 2010/0079357 | A1* | 4/2010 | Ozawa et al. | 345/46 |
| 2010/0171770 | A1* | 7/2010 | Inoue et al. | 345/690 |
| 2010/0220038 | A1* | 9/2010 | Chung et al. | 345/76 |
| 2010/0328359 | A1* | 12/2010 | Inoue et al. | 345/690 |
| 2011/0050666 | A1* | 3/2011 | Inoue et al. | 345/211 |
| 2011/0074757 | A1* | 3/2011 | Chung et al. | 345/211 |
| 2011/0080395 | A1* | 4/2011 | Chung | 345/211 |
| 2011/0084958 | A1* | 4/2011 | Choi et al. | 345/213 |
| 2011/0102403 | A1* | 5/2011 | Kim | 345/211 |
| 2011/0227885 | A1* | 9/2011 | Chung et al. | 345/204 |
| 2012/0248435 | A1* | 10/2012 | Koyama | 257/43 |

OTHER PUBLICATIONS

Korean Patent Abstract No. 10-2006-0056791 A, publised May 25, 2006 for KR 10-0739318 listed above, 1 page.

* cited by examiner

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2012-0056804, filed on May 29, 2012, in the Korean Intellectual Property Office, the entire content of which is incorporated herein by reference.

BACKGROUND

1. Field

Aspects of embodiments of the present invention relate to an organic light emitting display device and a driving method of the organic light emitting display device.

2. Description of the Related Art

Recently, various flat panel displays having reduced weight and volume when compared to that of cathode ray tube devices have been developed. Example flat panel displays include a liquid crystal display, a field emission display, a plasma display panel, an organic light emitting display device, and the like.

Among the flat panel displays, the organic light emitting display device, which displays an image using organic light emitting diodes (OLEDs) that generate light by recombination between electrons and holes, has a rapid response speed and is driven with low power consumption. The organic light emitting display device includes a plurality of data lines, scan lines, and a plurality of pixels arranged in a matrix form at crossing regions of the data lines and scan lines, and between power lines. The pixels each generally include an OLED and at least two transistors including at least one driving transistor.

The organic light emitting display device has low power consumption. However, an amount of current flowing to the OLEDs varies according to a variation in threshold voltage between driving transistors included in each of the pixels, which generates a non-uniform display. For example, the driving transistor characteristics may vary according to a variable in a manufacturing process of the driving transistor provided in each of the pixels. Presently, it is impossible or impractical to manufacture all of the transistors of the organic light emitting display device to have the same characteristics. Therefore, a variation in threshold voltage of the driving transistors occurs.

One proposal to address this is to add a compensation circuit including a plurality of transistors and a capacitor to each of the pixels. The compensation circuit compensates for the variation in threshold voltage of the driving transistors by diode-connecting the driving transistor during a scan signal supply period.

Meanwhile, other proposals to improve image quality include driving a panel at a high resolution and/or a high driving frequency. However, when the panel is driven at a high resolution and/or high driving frequency, the threshold voltage may not be adequately compensated for in areas of low brightness, such that low brightness mura (unevenness or nonuniformity) is generated. For example, when displaying a low brightness image, a relatively small amount of current flows to the pixels, such that the threshold voltage may not be adequately compensated for during a set time (for instance, a predetermined time, such as during a scan signal supply period).

SUMMARY

Aspects of embodiments of the present invention relate to an organic light emitting display device and a driving method of the organic light emitting display device. Further aspects relate to an organic light emitting display device capable of stably compensating for a threshold voltage of the driving transistors, and a driving method of the organic light emitting display device.

According to an exemplary embodiment of the present invention, an organic light emitting display device is provided. The organic light emitting display device includes pixels each having a driving transistor and being configured to initialize a voltage of the driving transistor by an initialization power, a gray level determining unit for generating a gray level value using externally supplied data, and an initialization power generator for controlling a voltage level of the initialization power to correspond to the gray level value.

The gray level value may correspond to an average gray level of the externally supplied data corresponding to one frame.

The gray level value may correspond to a lowest gray level of the externally supplied data corresponding to one frame.

The gray level value may correspond to an average gray level of the externally supplied data corresponding to one horizontal line.

The gray level value may correspond to a lowest gray level of the externally supplied data corresponding to one horizontal line.

The initialization power generator may be configured to control the voltage level of the initialization power to decrease as the gray level value increases from a low brightness gray level value to a high brightness gray level value.

The initialization power generator may be configured to control the voltage level of the initialization power so that a first voltage difference between the initialization power and a first data signal corresponding to a low brightness is greater than a second voltage difference between the initialization power and a second data signal corresponding to a high brightness.

The initialization power generator may be further configured to control the voltage level of the initialization power so that a voltage difference between the initialization power and a data signal increases from the first voltage difference to the second voltage difference as the data signal decreases from the first data signal to the second data signal.

Each of the pixels may include an organic light emitting diode (OLED), the driving transistor for controlling an amount of current supplied to the OLED, and a second transistor coupled between a gate electrode of the driving transistor and the initialization power generator.

Each of the pixels may further include a third transistor for diode-connecting the driving transistor.

According to another exemplary embodiment of the present invention, a driving method of an organic light emitting display device including pixels each having a driving transistor and being configured to initialize a voltage of a gate electrode of the driving transistor using an initialization power is provided. The driving method includes extracting a gray level value using externally supplied data, and controlling a voltage level of the initialization power to correspond to the gray level value.

The gray level value may correspond to an average gray level of the externally supplied data corresponding to one frame.

The gray level value may corresponds to a lowest gray level of the externally supplied data corresponding to one frame.

The gray level value may correspond to an average gray level of the externally supplied data corresponding to one horizontal line.

The gray level value may correspond to a lowest gray level of the externally supplied data corresponding to one horizontal line.

The controlling of the voltage level of the initialization power to correspond to the gray level value may include decreasing the voltage level of the initialization power corresponding to a low brightness gray level value toward the initialization power corresponding to a high brightness gray level.

BRIEF DESCRIPTION OF THE DRAWINGS

The accompanying drawings, together with the specification, illustrate exemplary embodiments of the present invention, and, together with the description, serve to explain aspects and principles of the present invention.

DETAILED DESCRIPTION

Figure 1:
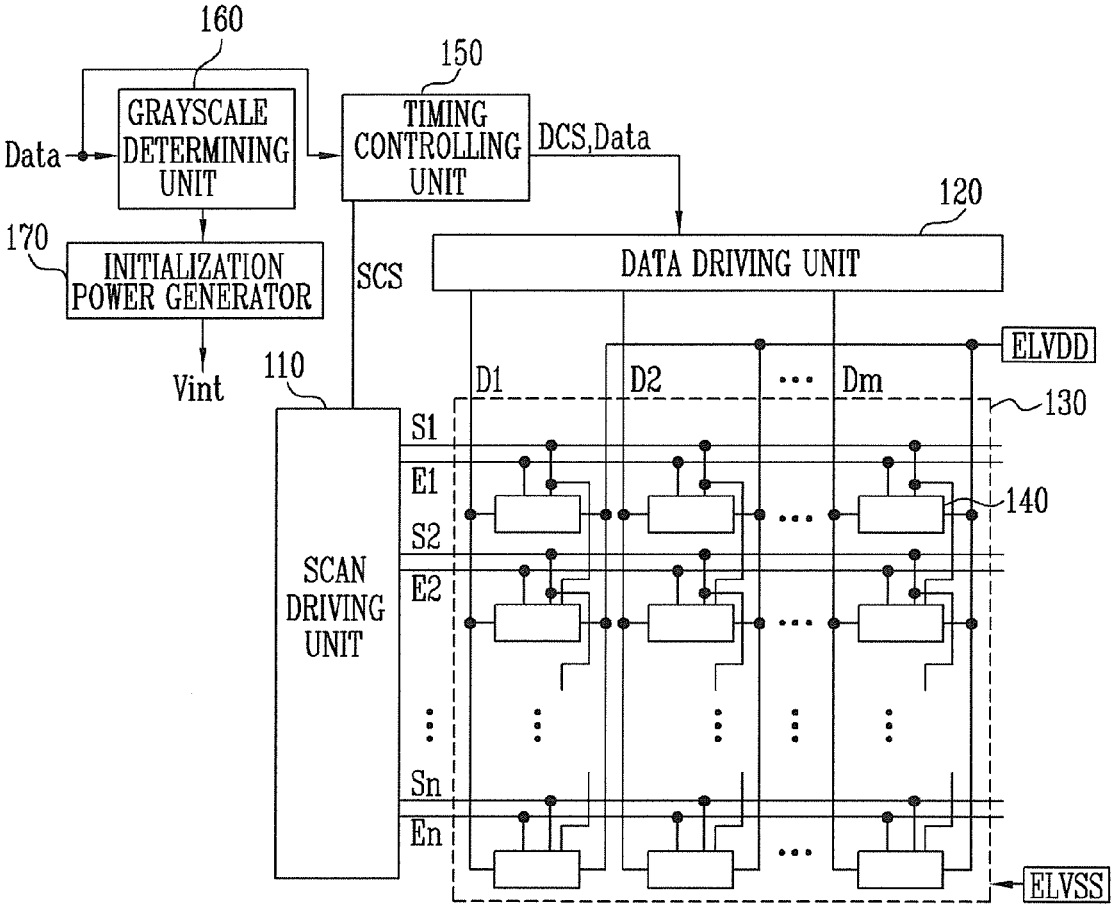
FIG. 1 is a view showing an organic light emitting display device according to an exemplary embodiment of the present invention.

Hereinafter, certain exemplary embodiments according to the present invention will be described with reference to the accompanying drawings. Here, when a first element is described as being coupled to a second element, the first element may be directly coupled (e.g., connected) to the second element or indirectly coupled (e.g., electrically connected) to the second element via one or more third elements. Further, for brevity of description, some of the elements that may not be essential to a complete understanding of an embodiment may be omitted for clarity. In addition, like reference numerals refer to like elements throughout. Exemplary embodiments of the present invention that may be practiced by those of ordinary skill in the art to which the present invention pertains will now be described in detail with reference to FIGS. 1 to 4.

FIG. 1 is a view showing an organic light emitting display device according to an exemplary embodiment of the present invention.

Referring to FIG. 1, the organic light emitting display device includes a display unit 130 including pixels 140 positioned at crossing regions of scan lines S1 to Sn and data lines D1 to Dm, a scan driving unit (or scan driver) 110 for driving the scan lines S1 to Sn and emitting light control lines E1 to En, a data driving unit (or data driver) 120 for driving the data lines D1 to Dm, and a timing controlling unit (or timing controller) 150 for controlling the scan driving unit 110 and the data driving unit 120. Further, the organic light emitting display device includes a grayscale determining unit (or gray level determining unit) 160 for determining a gray level (or a brightness) using externally supplied data and an initialization power generating unit 170 for controlling a voltage level of an initialization power Vint to correspond to the gray level determined in the grayscale determining unit (e.g., gray level determining unit) 160.

The timing controlling unit 150 generates data driving control signals DCS and scan driving control signals SCS corresponding to externally supplied synchronization signals. The data driving control signals DCS are supplied to the data driving unit 120, and the scan driving control signals SCS are supplied to the scan driving unit 110. In addition, the timing controlling unit 150 supplies the externally supplied data to the data driving unit 120.

The scan driving unit 110 receives the scan driving control signals SCS from the timing controlling unit 150. The scan driving unit 110 generates scan signals and sequentially supplies the generated scan signals to the scan lines S1 to Sn. In addition, the scan driving unit 110 generates light emitting control signals in response to the scan driving control signals SCS and sequentially supplies the generated light emitting control signals to the light emitting control lines E1 to En. Here, a width of the light emitting control signal is set to be the same as or wider than that of the scan signal. For example, the light emitting control signal supplied to the i-th light emitting control line Ei is overlapped with the signals supplied to the (i−1)-th and i-th scan lines Si−1 and Si.

The data driving unit 120 receives the data driving control signals DCS from the timing controlling unit 150. The data driving unit 120 generates data signals and supplies the generated data signals to the data lines D1 to Dm concurrently (for example, synchronized) with the scan signals.

The display unit 130 receives a first power from a first power supply ELVDD (for example, from an external first power supply ELVDD) and a second power from a second power supply ELVSS (for example, from an external second power supply ELVSS) and supplies them to each of the pixels 140. Each of the pixels 140 includes a driving transistor for controlling an amount of current supplied from the first power supply ELVDD to the second power supply ELVSS via the OLED, corresponding to the data signals. A gate electrode of the driving transistor is initialized to a voltage of the initialization power Vint before the data signals are supplied thereto.

The grayscale determining unit 160 receives the externally supplied data Data and generates the gray level value using the received data Data. Here, the gray level value may be selected, for example, as an average value (e.g., an average gray level value or brightness level) of the data Data corresponding to one frame or data having the lowest gray level in the data Data corresponding to one frame. In addition, the gray level value may be selected, for example, as an average value of the data corresponding to one horizontal line (e.g., a horizontal line of pixels 140 corresponding to the same i-th scan line Si) or data having the lowest gray level in the data corresponding to one horizontal line. In other embodiments, different representative gray level values may be generated by the grayscale determining unit 160.

When the gray level value is selected as the data having the lowest gray level, the voltage of the initialization power Vint is controlled such that a threshold voltage of the driving transistors may be stably compensated for at displayed images corresponding to low brightness. In addition, since the data of one frame or one horizontal line generally or frequently have similar gray levels, having the voltage of the initialization power Vint be controlled by the data having the lowest gray level still results in the threshold voltage being stably compensated for in the pixels 140.

When the gray level value is selected as the average value of the data, the voltage of the initialization power Vint is controlled so that the threshold voltage of the driving transistors may be stably compensated for corresponding to the brightness displayed in the pixels 140.

Figure 2:
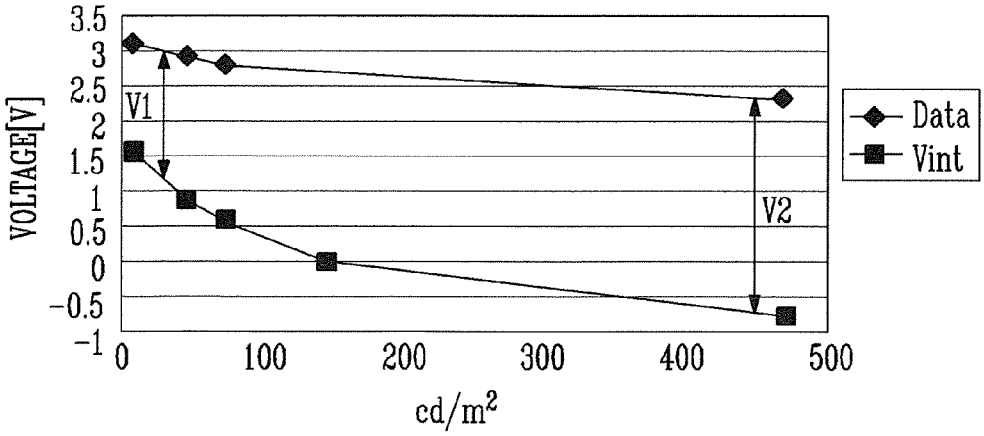
FIG. 2 is a view showing an example of initialization power generated in an initialization power generator shown in FIG. 1.

The initialization power generator 170 controls the voltage of the initialization power Vint corresponding to the gray level value supplied from the grayscale determining unit 160. Here, the initialization power generator 170 allows the initialization power Vint to decrease from a low brightness gray level value toward a high brightness gray level value as shown in FIG. 2. In addition, the initialization power generator 170 allows a voltage difference between the initialization power Vint and the data signal to increase from the low brightness gray level value toward the high brightness gray level value as shown in FIG. 2. In this case, the voltage difference between the data signal and the initialization power Vint is set to a first power difference V1 at the low brightness and is set to a second power difference V2 that is larger than the first voltage difference V1 at the high brightness.

When the data signal and the initialization power Vint are set to have the first voltage difference V1, that is, a low voltage difference, at a low brightness, the voltage of the gate electrode of the driving transistor included in each of the pixels 140 may stably increase from the voltage of initialization power Vint to the voltage of the data signal, corresponding to a small amount of current. Thus, when displaying low brightness, the threshold voltage may be stably compensated for in the pixels 140.

In addition, the data signal and the initialization power Vint are set to have the second voltage difference V2 at the high brightness gray level. Here, when displaying high brightness, a large current flows, such that the voltage of the gate electrode of the driving transistors may stably increase from the voltage of the initialization power Vint to the voltage of the data signal.

In a similar fashion, as shown in FIG. 2, the voltage difference between the data signal and the initialization power Vint may increase (for example, gradually increase) from the first voltage difference V1 to the second voltage difference V2 as the display goes from displaying low brightness to displaying high brightness. For example, this voltage difference increase may be continuous or stepwise (in one or more steps) according embodiments of the present invention.

As describe above, the voltage of the initialization power Vint is controlled corresponding to the gray level value corresponding to one frame or one horizontal line, thereby making it possible to stably compensate for the voltage of the driving transistor included in each of the pixels 140. In other embodiments, different regions, such as groups of horizontal lines, may be used in choosing representative gray level values.

Figure 3:
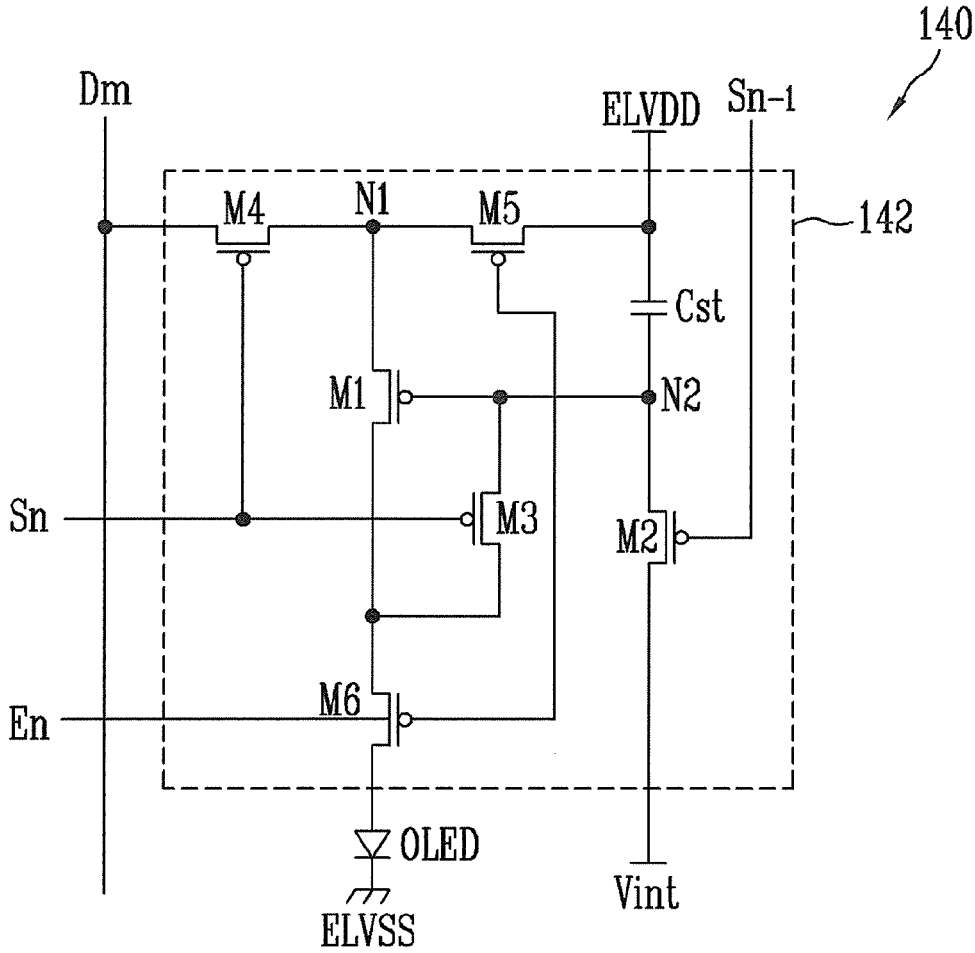
FIG. 3 is a circuit diagram showing an example of a pixel shown in FIG. 1.

FIG. 3 is a circuit diagram showing an example of a pixel 140 shown in FIG. 1. In FIG. 3, the pixel 140 coupled to an m-th data line Dm, an n-th scan line Sn, an (n−1)-th scan line Sn−1, and an n-th light emitting control line En will be shown for convenience of explanation.

Referring to FIG. 3, the pixel 140 includes an organic light emitting diode (OLED) and a pixel circuit 142 coupled to the data line Dm, the (n−1)-th and n-th scan lines Sn−1 and Sn, and the light emitting control line En to control an amount of current supplied to the OLED. An anode electrode of the OLED is coupled to the pixel circuit 142, and a cathode electrode thereof is coupled to the second power supply ELVSS. Here, the voltage value of the second power supply ELVSS is set to be lower than that of the first power supply ELVDD. The OLED generates light having a set brightness (for example, a predetermined brightness) corresponding to the amount of current supplied from the pixel circuit 142.

The pixel circuit 142 controls the amount of current supplied to the OLED, corresponding to the data signal supplied to the data line Dm when the scan signal is supplied to the n-th scan line Sn. To this end, the pixel circuit 142 includes first to sixth transistors M1 to M6 and a storage capacitor Cst.

A first electrode of the fourth transistor M4 is coupled to the data line Dm, and a second electrode thereof is coupled to a first node N1. In addition, a gate electrode of the fourth transistor M4 is coupled to the n-th scan line Sn. The fourth transistor M4 is turned on when the scan signal is supplied to the n-th scan line Sn, thereby supplying the data signal supplied from the data line Dm to the first node N1.

A first electrode of the first transistor M1 (i.e., a driving transistor) is coupled to the first node N1, and a second electrode thereof is coupled to a first electrode of the sixth transistor M6. In addition, a gate electrode of the first transistor M1 is coupled to a second node N2. The first transistor M1 supplies current corresponding to the voltage charged in the storage capacitor Cst to the OLED.

A first electrode of the third transistor M3 is coupled to the second electrode of the first transistor M1, and a second electrode thereof is coupled to the second node N2. In addition, a gate electrode of the third transistor M3 is coupled to the n-th scan line Sn. The third transistor M3 is turned on when the scan signal is supplied to the n-th scan line Sn, thereby diode-connecting the first transistor M1.

The second transistor M2 is coupled between the second node N2 and the initialization power Vint. In addition, a gate electrode of the second transistor M2 is coupled to the (n−1)-th scan line Sn−1. The second transistor M2 is turned on when the scan signal is supplied to the (n−1)-th scan line Sn−1, thereby supplying the voltage of the initialization power Vint to the second node N2. Here, the initialization power Vint is set to a voltage lower than the data signal (as shown in FIG. 2).

A first electrode of the fifth transistor M5 is coupled to the first power supply ELVDD and a second electrode thereof is coupled to the first node N1. Further, a gate electrode of the fifth transistor M5 is coupled to the light emitting control line En. The fifth transistor M5 is turned on when the light emitting control signal is not supplied from the light emitting control line En, thereby electrically connecting the first power supply ELVDD and the first node N1 to each other.

The first electrode of the sixth transistor M6 is coupled to the second electrode of the first transistor M1, and a second electrode thereof is coupled to the anode electrode of the OLED. Further, a gate electrode of the sixth transistor M6 is coupled to the light emitting control line En. The sixth transistor M6 is turned on when the light emitting control signal is not supplied, thereby supplying the current supplied from the first transistor M1 to the OLED.

Figure 4:
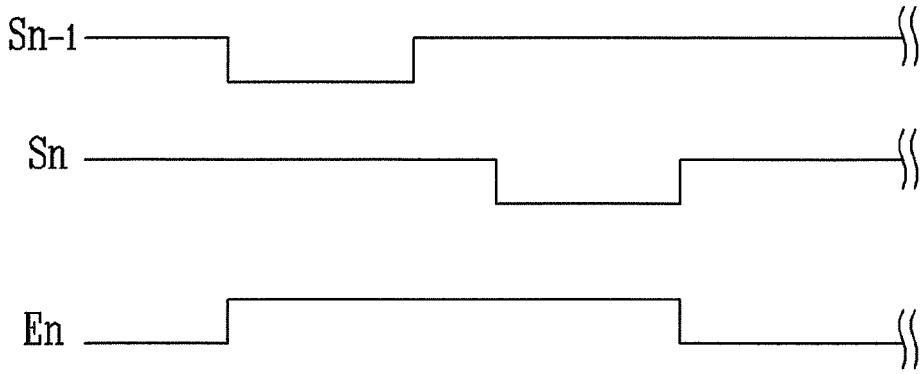
FIG. 4 is a waveform diagram showing an example of a driving waveform supplied to the pixel shown in FIG. 3.

FIG. 4 is a waveform diagram showing an example of a driving waveform supplied to the pixel shown in FIG. 3.

Referring to FIG. 4, the scan signal is first supplied to the (n−1)-th scan signal line Sn−1, thereby turning on the second transistor M2. When the second transistor M2 is turned on, the voltage of the initialization power Vint is supplied to the second node N2.

Here, the voltage of the initialization power Vint is determined (for example, automatically determined in the initialization power generator) corresponding to the gray level value determined by the grayscale determining unit 160. In other words, with the low brightness gray level, the voltage of the initialization power Vint is set to a high voltage, and with the high brightness gray level, the voltage of the initialization power Vint is set to a low voltage. However, the initialization power Vint is set to a voltage lower than that of the data signal. Further, the voltage difference between the initialization power Vint and the data signal may increase when displaying low brightness gray levels to displaying high brightness gray levels.

After the voltage of the initialization power Vint is supplied to the second node N2, the scan signal is supplied to the n-th scan line Sn. The third and fourth transistors M3 and M4 are turned on when the scan signal is supplied to the n-th scan line Sn. When the fourth transistor M4 is turned on, the data signal supplied to the data line Dm is supplied to the first node N1. Since the second node N2 is initialized to the voltage of the initialization power Vint, the first transistor M1 is turned on. Accordingly, the data signal supplied to the first node N1 is supplied to the second node N2 via the diode-connected first transistor M1. In addition, the voltage at the second node N2 increases to a voltage generated by subtracting a threshold voltage of the first transistor M1 from the voltage of the data signal.

The voltage of the initialization power Vint is determined corresponding to the gray level value. For instance, when the data signal corresponding to the low brightness gray level is supplied, the voltage difference between the initialization power Vint and the data signal (and that is supplied to the second node N2) is set to be low. In addition, when the data signal corresponding to the high brightness gray level is supplied, the voltage difference between the initialization power Vint and the data signal, that is supplied to the second node N2, is set to be high. Since the voltage of the initialization power Vint is determined using the gray level value, the threshold voltage of the first transistor M1 may be stably compensated for corresponding to the voltage of the data signal.

The voltage applied to the second node N2 is stored in the storage capacitor Cst. After a set voltage (for example, a predetermined voltage) is charged in the storage capacitor Cst, the supply of the light emitting control signal to the light emitting control line En is stopped, such that the fifth and sixth transistors M5 and M6 are turned on. When the fifth and sixth transistors M5 and M6 are turned on, a current path from the first power supply ELVDD to the OLED is formed. In this case, the first transistor M1 controls an amount of current flowing from the first power supply ELVDD to the OLED, corresponding to the voltage charged in the storage capacitor Cst.

Although the pixel 140 includes six transistors and a single capacitor in the above description, the present invention is not limited thereto. Embodiments of the present invention may be applied to various types of pixels that diode-connect the driving transistor M1 to compensate for the threshold voltage of the driving transistor M1. When diode-connecting the driving transistor M1, the voltage of the gate electrode of the driving transistor M1 is initialized using the initialization power Vint.

As set forth in the above exemplary embodiments, with the organic light emitting display device and the driving method thereof, the voltage of the initialization power is controlled corresponding to the gray level of the data, thereby making it possible to stably compensate for the threshold voltage variation between the driving transistors regardless of the gray levels being displayed.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

pixels each comprising a driving transistor and being configured to initialize a voltage of a gate electrode of the driving transistor to a common variable gate initialization voltage;

a gray level determining unit for generating a representative gray level value of a frame using externally supplied data corresponding to the frame; and an initialization power generator for supplying the common variable gate initialization voltage to the pixels and varying the common variable gate initialization voltage each frame in correspondence with the representative gray level value of the frame.

2. The organic light emitting display device according to claim 1, wherein the gray level value corresponds to an average gray level of the externally supplied data corresponding to one frame.

3. The organic light emitting display device according to claim 1, wherein the gray level value corresponds to a lowest gray level of the externally supplied data corresponding to one frame.

4. The organic light emitting display device according to claim 1, wherein the gray level value corresponds to an average gray level of the externally supplied data corresponding to one horizontal line.

5. The organic light emitting display device according to claim 1, wherein the gray level value corresponds to a lowest gray level of the externally supplied data corresponding to one horizontal line.

6. The organic light emitting display device according to claim 1, wherein the initialization power generator is configured to decrease the common variable gate initialization voltage as the representative gray level value increases from a low brightness gray level value to a high brightness gray level value.

7. The organic light emitting display device according to claim 1, wherein the initialization power generator is configured to control the common variable gate initialization voltage so that a first voltage difference between the common variable gate initialization voltage and a first data signal corresponding to a first representative gray level value of a low brightness is less than a second voltage difference between the common variable gate initialization voltage and a second data signal corresponding to a second representative gray level value of a high brightness.

8. The organic light emitting display device according to claim 7, wherein the initialization power generator is further configured to control the common variable gate initialization voltage so that a voltage difference between the common variable gate initialization voltage and a data signal corresponding to the representative gray level increases from the first voltage difference to the second voltage difference as the data signal decreases from the first data signal to the second data signal.

9. The organic light emitting display device according to claim 1, wherein each of the pixels comprises:

an organic light emitting diode (OLED);

the driving transistor for controlling an amount of current supplied to the OLED; and a second transistor coupled between a gate electrode of the driving transistor and the initialization power generator.

10. The organic light emitting display device according to claim 9, wherein each of the pixels further comprises a third transistor for diode-connecting the driving transistor.

11. A driving method of an organic light emitting display device comprising pixels each having a driving transistor and being configured to initialize a voltage of a gate electrode of the driving transistor to a common variable gate initialization voltage, the driving method comprising:

extracting a representative gray level value of a frame using externally supplied data corresponding to the frame; and supplying the common variable gate initialization voltage to the pixels and varying the common variable gate initialization voltage each frame in correspondence with the representative gray level value of the frame.

12. The driving method according to claim 11, wherein the gray level value corresponds to an average gray level of the externally supplied data corresponding to one frame.

13. The driving method according to claim 11, wherein the gray level value corresponds to a lowest gray level of the externally supplied data corresponding to one frame.

14. The driving method according to claim 11, wherein the gray level value corresponds to an average gray level of the externally supplied data corresponding to one horizontal line.

15. The driving method according to claim 11, wherein the gray level value corresponds to a lowest gray level of the externally supplied data corresponding to one horizontal line.

16. The driving method according to claim 11, wherein the varying of the common variable gate initialization voltage comprises decreasing the common variable gate initialization voltage as the representative gray level value increases from a low brightness gray level value to a high brightness gray level.

* * * * *